US005921225A

United States Patent [19]

Nakamura

[11] Patent Number: 5,921,225

[45] Date of Patent: Jul. 13, 1999

[54] INTAKE CONTROL MECHANISM FOR MARINE PROPULSION UNIT

[75] Inventor: Mitsuyoshi Nakamura, Iwata, Japan

[73] Assignee: Yamaha Hatsudoki Kabushiki Kaisha, Iwata, Japan

[21] Appl. No.: 08/934,720

[22] Filed: Sep. 22, 1997

[30] Foreign Application Priority Data

Sep. 20, 1996 [JP] Japan ..... 8-271654

[51] Int. Cl.[6] ..... F02B 13/00

[52] U.S. Cl. ..... 123/583; 123/580

[58] Field of Search ..... 123/579, 583, 123/413, 400, 179.18, 580, 183, 336

[56] References Cited

U.S. PATENT DOCUMENTS

| | | | |
|---|---|---|---|
| 2,423,059 | 6/1947 | Winkler | 123/119 |
| 4,418,676 | 12/1983 | Iwao | 123/580 |
| 4,971,006 | 11/1990 | Imaeda . | |
| 4,995,370 | 2/1991 | Imaeda et al. . | |
| 5,036,805 | 8/1991 | Yamamoto et al. | 123/59 |
| 5,088,468 | 2/1992 | Imaeda . | |
| 5,515,825 | 5/1996 | Arai et al. . | |
| 5,517,963 | 5/1996 | Yoshida et al. . | |
| 5,517,977 | 5/1996 | Nakai et al. | 123/580 |
| 5,522,746 | 6/1996 | Shishido et al. | 440/76 |
| 5,524,596 | 6/1996 | Nakai et al. . | |
| 5,535,718 | 7/1996 | Nakai et al. | 123/336 |
| 5,606,952 | 3/1997 | Kanno et al. . | |
| 5,722,364 | 3/1998 | Watanabe et al. | 123/336 |

*Primary Examiner*—Erick R. Solis
*Assistant Examiner*—Arnold Castro
*Attorney, Agent, or Firm*—Knobbe, Martens, Olson & Bear LLP

[57] ABSTRACT

An intake control mechanism for controlling the flow of air through an air intake of an engine is disclosed. The air intake comprises an intake member defining an intake passage corresponding to each combustion chamber of the engine. A throttle valve and a choke valve are movable positioned in each passage. The intake control mechanism includes a choke control and throttle control for moving the choke and throttle valves, respectfully. The choke control includes a choke linkage and the throttle control includes a throttle linkage, the linkages positioned outside of the intake member and between the choke and throttle valves. Preferably, the choke linkage is positioned between the throttle linkage and the intake member.

10 Claims, 9 Drawing Sheets

INTAKE CONTROL MECHANISM FOR MARINE PROPULSION UNIT

FIELD OF THE INVENTION

The present invention relates to an intake control mechanism. More particularly, the invention is a throttle and choke control arrangement for an engine of the type powering a watercraft.

BACKGROUND OF THE INVENTION

Watercraft, especially those of the type known as personal watercraft, are commonly powered by internal combustion engines positioned within their hulls. These engines are arranged to drive a water propulsion device for propelling the craft.

As is well known, it is undesirable to allow water to enter the intake system of such an engine, as the water may foul the combustion chamber(s) and cause the engine to stall or stop. In addition, the water may be passed through the engine to a catalyst positioned in the exhaust system, damaging it as well.

It is common for the air intake to be positioned at the top of the engine and may open upwardly. In the watercraft setting, this is undesirable, since water may flow directly into the intake and down into the engine. Thus, as one method for reducing the opportunity for water to enter the intake system, the air intake opening leading to the engine may be positioned within an air box, with air supplied to the air box through an inlet or pipe.

A problem also exists with this arrangement relating to the nature of personal watercraft. This type of watercraft is often capsized, laying on either side or completely upside down. When this occurs, water in the engine compartment or elsewhere may then still enter the air box or air intake to the engine.

In order to solve the above-stated problems, an intake box may be provided, with the opening to the air intake pipe positioned within the box and above a lower surface of the box. The box is also preferably large, so that water does not fill the box and flow up over the intake pipe and into the engine.

A problem with the large intake box, however, is that it interferes with the choke and throttle control of the intake system. In particular, these engines typically have positioned in each intake passage a throttle plate and a choke plate for controlling the flow of air through the intake passage. The choke plate is positioned near the top of the intake passage. The position of the choke plate requires that an external choke control also be positioned near the top end of the intake passage, but this interferes with the use of a large intake box, which occupies the same space.

In addition, so that the throttle and choke controls are easy to operate, a long control lever is utilized. The long lever associated with these controls also interferes with the use of a large intake box as is desired to prevent water entry into the engine through the intake system.

An intake control mechanism for an air intake of an engine of the type utilized to power a watercraft and which allows for use of a large intake box, is desired.

SUMMARY OF THE INVENTION

In accordance with the present invention there is provided an improved intake control mechanism for an air intake of an engine powering a watercraft. Preferably, the engine is of the type including a plurality of combustion chambers and the air intake includes an intake member defining an intake passage corresponding to each combustion chamber for delivering air thereto. The air intake preferably also includes a large intake box at the end of each intake passage opposite the engine.

The intake control mechanism includes a throttle valve and a choke valve movably positioned in each intake passage for controlling the flow rate of air therethrough. The intake control mechanism further includes a choke control and throttle control for moving the choke and throttle valves, respectively. The choke control includes a choke linkage connected to each choke valve and a linkage actuator, and the throttle control includes a throttle linkage connected to each throttle valve and a linkage actuator.

The choke and throttle linkages are positioned outside of the intake member and along that portion of the intake member between which are housed the choke and throttle valves. Preferably, the choke linkage is positioned between the throttle linkage and the intake member, such that the linkages are overlapping.

Preferably, each choke valve comprises a plate mounted to a shaft, and each throttle valve comprises a plate mounted to a shaft. The choke linkage comprises a lever positioned outside of the intake member and connected to the shaft corresponding to a choke plate, and a link extending between each lever. The throttle linkage likewise preferably comprise a lever positioned outside of the intake member and connected to the shaft corresponding to a throttle plate, and a link extending between each lever. Preferably, the points of connection between the links and levers of the throttle linkage alternate with the points of connection between the links and levers of the choke linkage.

A wire actuator may be used to control each of the choke and throttle linkages. In addition, means are provided for biasing each choke valve into an open position and each throttle valve in to closed position.

The orientation of the intake control and its compact arrangement permit use of a large intake box with the air intake system, which is advantageous in the watercraft environment. In addition, the arrangement of the intake control still permits use of large levers connected to the choke and throttle valves, such that the operation of the valves (against the biasing force) is easy.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an intake control mechanism. The intake control mechanism is particularly suited for use in controlling the flow of air through an air intake of an engine utilized to power a watercraft, and more particularly, a personal watercraft. The intake control mechanism has a compact design, permitting use of a large intake box.

Figure 1:
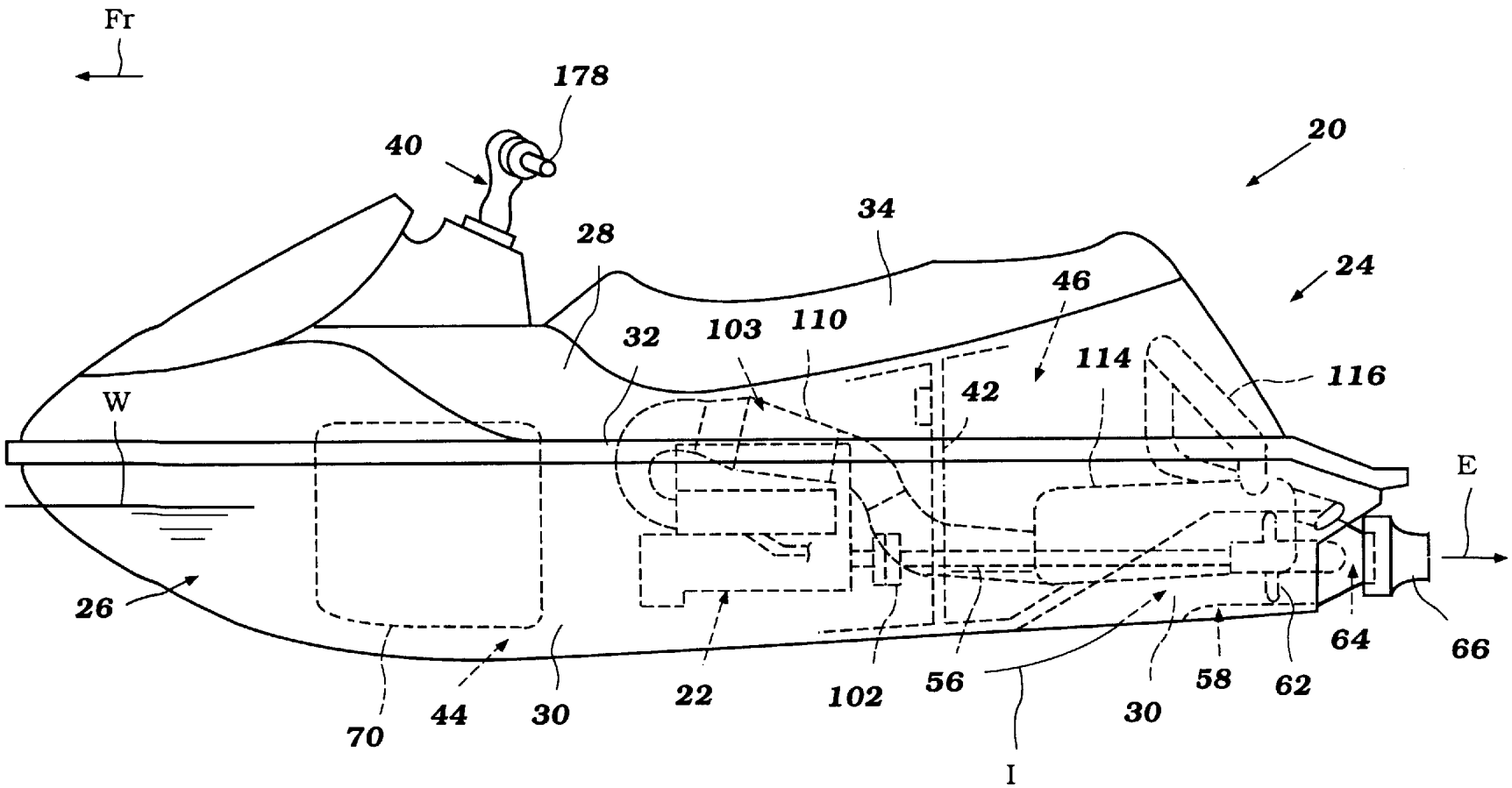
FIG. 1 is a side view of a personal watercraft of the type powered by an engine having an air intake in accordance with the present invention, the engine and other watercraft components positioned within a hull of the watercraft illustrated in phantom.
Figure 2:
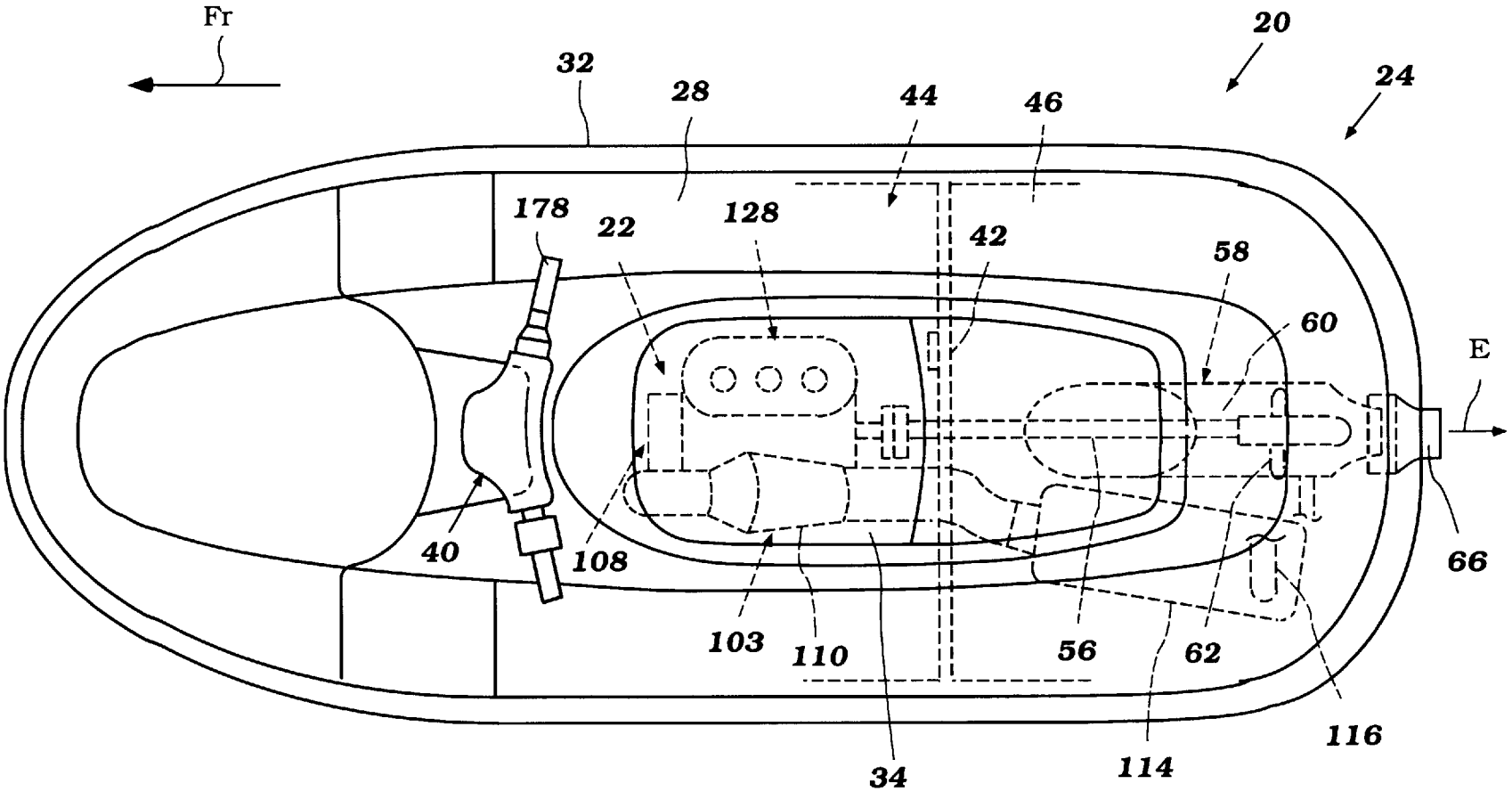
FIG. 2 is a top view of the watercraft illustrated in FIG. 1, with the engine and other watercraft components positioned within the hull of the watercraft illustrated in phantom.

FIGS. 1 and 2 illustrate a watercraft 20 having a watercraft body 24 comprising a hull 26 having a top portion or deck 28 and a lower portion 30. A gunnel 32 defines the intersection of the hull 26 and the deck 28.

A seat 34 is positioned on the top portion 28 of the hull 26. The seat 34 may be connected to a removable deck member for use in accessing an engine compartment within the hull 26, as described in more detail below. A steering handle 40 is provided adjacent the seat 32 for use by a user in directing the watercraft 20.

Figure 3:
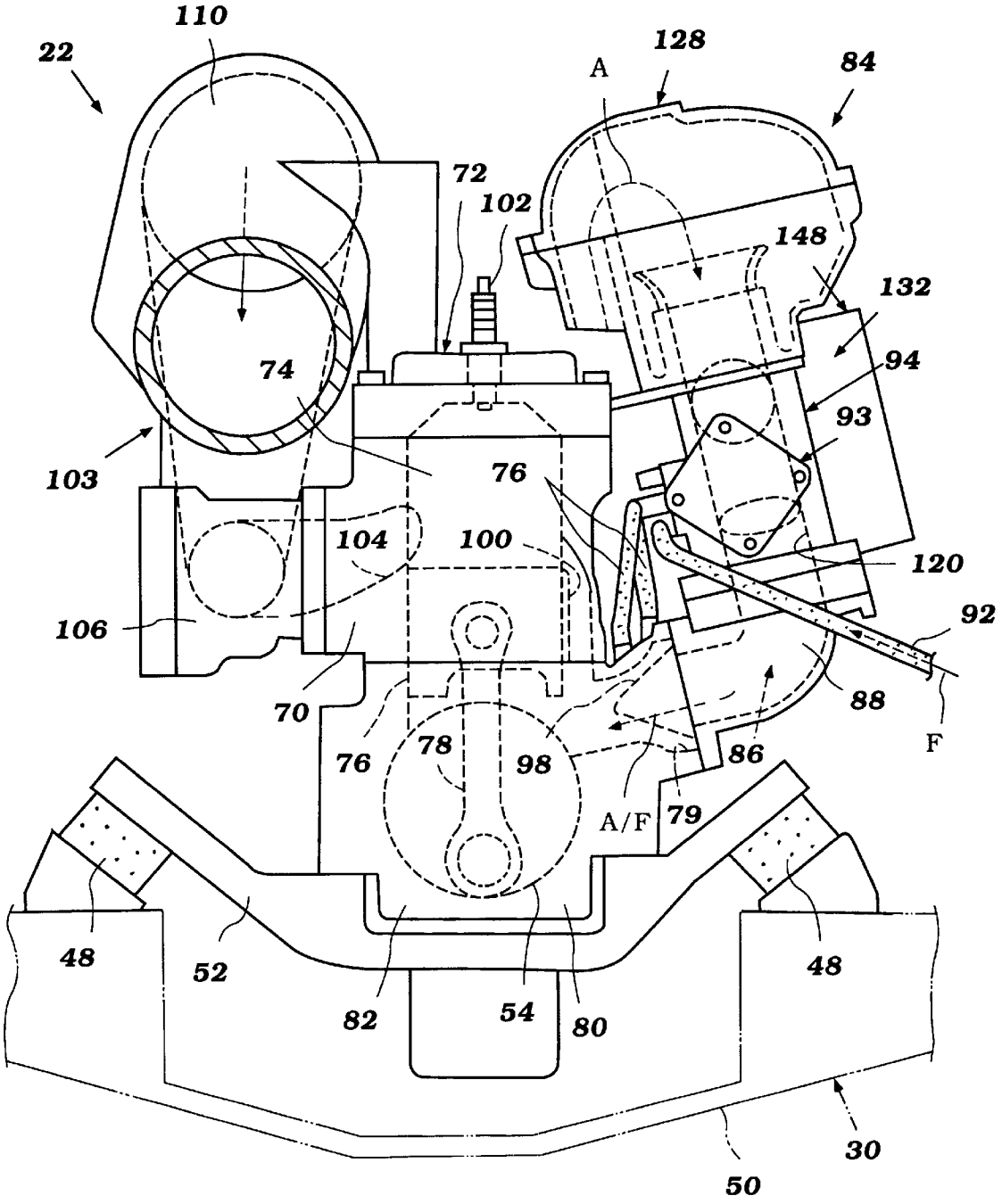
FIG. 3 is an end view, in partial cross-section, of the engine illustrated in FIG. 1.

The top and bottom portions 28,30 of the hull 26, along with a bulkhead 42, define an engine compartment 44 and a pumping chamber 46. An engine 22 is positioned in the engine compartment 44. As best illustrated in FIG. 3, the engine 22 is connected to the hull 26 via several engine mounts 48 connected to a bottom 50 of the lower portion 30 of the hull 26. The mounts 48 connect an engine support plate 52 to the hull 26. Preferably, the engine mounts 48 include at least one section comprising a material for damping vibration transmission between the hull 26 and engine 22. The engine 22 is preferably partially accessible through a maintenance opening accessible by removing the removable deck member on which the seat 34 is mounted.

The engine 22 has a crankshaft 54 (see FIG. 3) which is in driving relation with an impeller shaft 56. The impeller shaft 56 rotationally drives a means for propelling water of a propulsion unit 58, which unit extends out a stem portion of the watercraft 20 (i.e. that end of the watercraft 20 opposite the front end facing in the direction Fr in FIG. 1).

The propulsion unit 58 includes a propulsion passage 60 having an intake port which extends through the lower portion 30 of the hull 26 through which water is drawn in the direction I. The means for propelling water, preferably an impeller 62 driven by the impeller shaft 56, is positioned in the passage 60. The passage 60 also has an outlet 64 positioned within a nozzle 66. The nozzle 66 is mounted for movement up and down and to the left and right, for expelling water E under force, whereby the direction of the propulsion force for the watercraft 20 may be varied.

The engine 22 is best illustrated in FIG. 3. As illustrated therein, the engine 22 is preferably of the three-cylinder, two-cycle variety. Of course, the engine 22 may have as few as one, or more than three, cylinders, as may be appreciated by one skilled in the art. In addition, the engine may operate on a four-cycle or other operating principle.

The engine 22 includes a cylinder block 70 having a cylinder head 72 connected thereto and cooperating therewith to define two combustion chambers 74. Each combustion chamber 74 is defined by a cylinder wall within the block 70, a recessed area in the cylinder head 72, and the head of a piston 76. A piston 76 is movably mounted in each cylinder, and connected to the crankshaft 54 via a connecting rod 78, as is well known in the art.

The crankshaft 54 is rotatably journalled by a number of sealed bearings with respect to the cylinder block 70 within a crankcase chamber 80. Preferably, the chamber 80 is defined by a crankcase cover member 82 which extends from a bottom portion of the cylinder block 70. As is well known, the crankshaft 54 has pin portions extending between web portions thereof, with each connecting rod 78 connected to one of the pin portions and the web portions rotatably supported by the bearings mounted to members extending from the block 70 and cover 82.

As illustrated in FIG. 3 and as described in more detail below, the engine 22 includes means for providing an air and fuel mixture to each combustion chamber 74. Preferably, air is drawn into the engine compartment 44 through one or more air inlets in the hull 26. Air is then drawn through an air intake 84 described in more detail and in accordance with the present invention, including an intake passage 86 in an intake manifold 88 leading to the engine 22.

Figure 7:
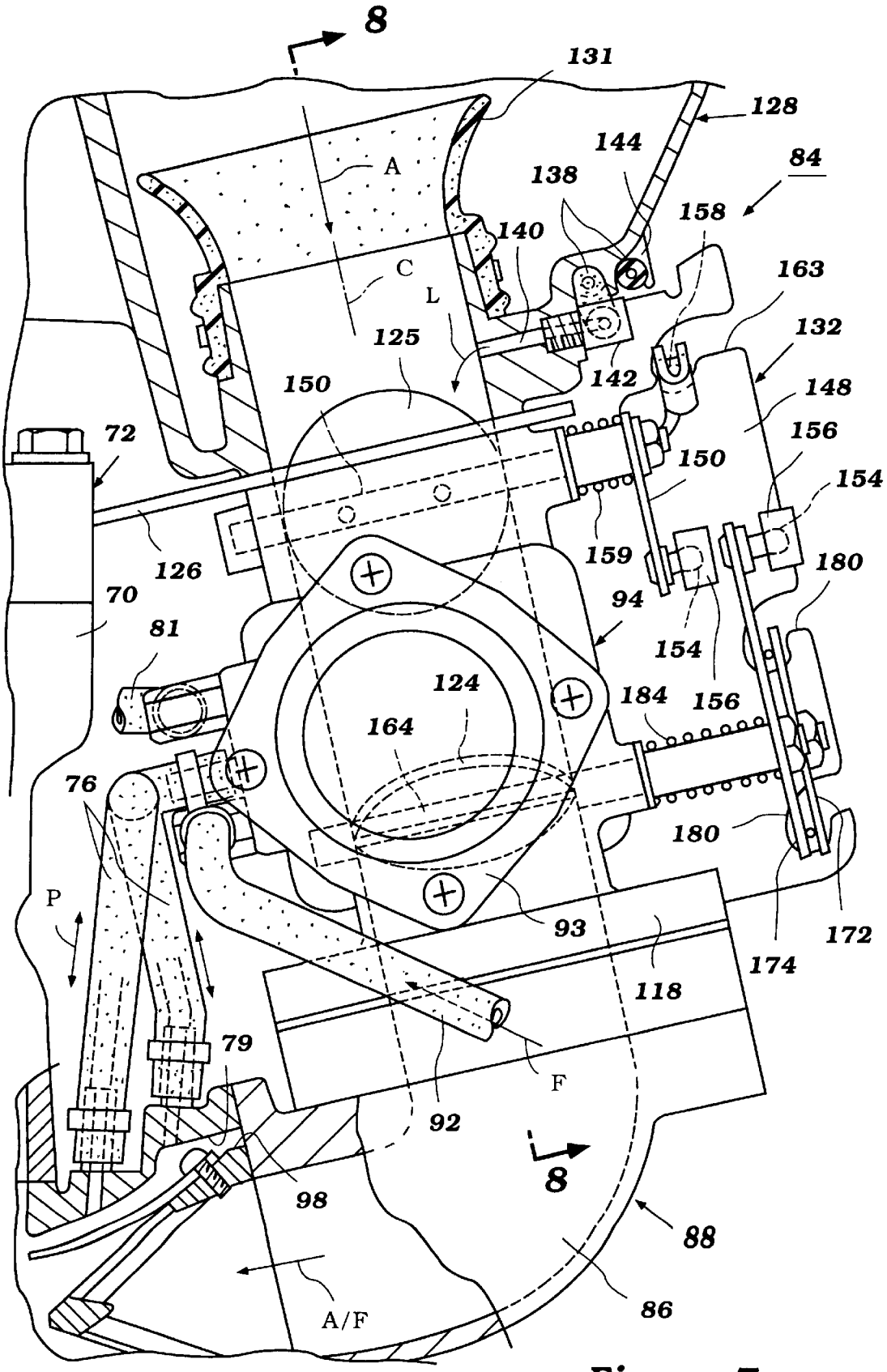
FIG. 7 is an view, in partial cross-section, of the air intake and intake control mechanism as illustrated in FIG. 3.

Fuel is provided to each combustion chamber 74 for combustion. Preferably, fuel is combined with the incoming air. In particular, fuel is drawn from a fuel tank 90 (see FIG. 1) positioned in the engine compartment 44 by a fuel pump 93 and delivered through a fuel delivery line 92 to a charge former such as a carburetor 94. The fuel pump 93 is preferably a diaphragm operated variety. Preferably, changes in air pressure within the crankcase operate the pump 93. As illustrated in FIG. 7, an air pressure line 91 is provided between the portion of the crankcase 80 corresponding to each cylinder 74 and a fuel pump 93 providing fuel to a carburetor 94 corresponding thereto. Variations in air pressure P within the crankcase 80 are transmitted to the diaphragm of the pump 93, as is well known in the art. The movement of the diaphragm serves to pump fuel from the tank 90 through the delivery line 92 to at least one delivery passage 77 extending into the carburetor 94 (see FIG. 8). Fuel which is pumped by the pump 93 but not delivered into the carburetor 94 is preferably returned to the fuel tank 90 through a fuel return line 81.

Figure 6:
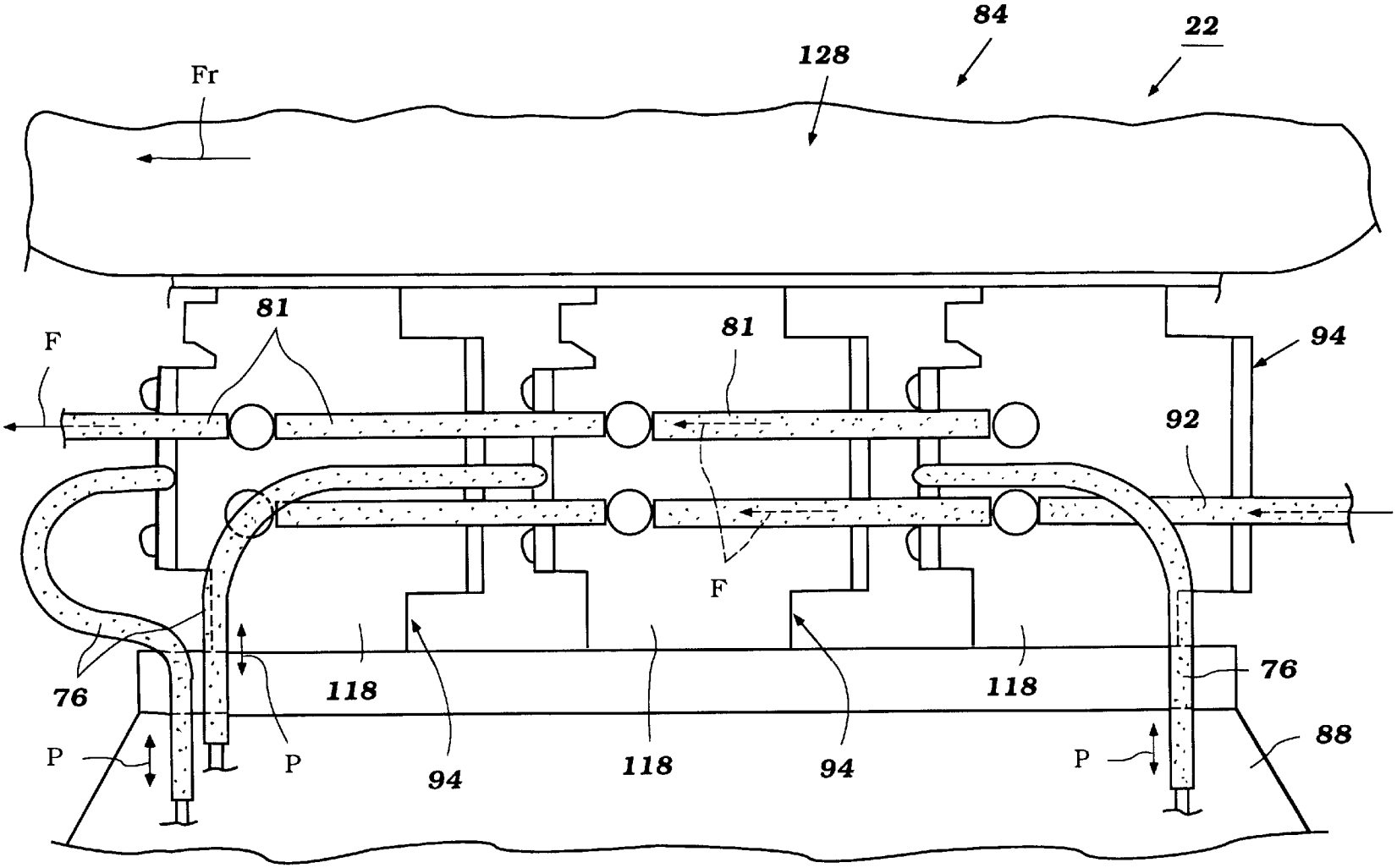
FIG. 6 is a side view of the air intake from that illustrated in FIG. 4, taken in the direction of lines 6—6 in FIG. 5.

As best illustrated in FIG. 6, the supply line 92 is preferably connected to each fuel pump 93 in linear fashion, one pump after another. Similarly, the return line 81 extends in linear fashion from a first pump 93 and then to the other pumps 93 in succession.

Figure 4:
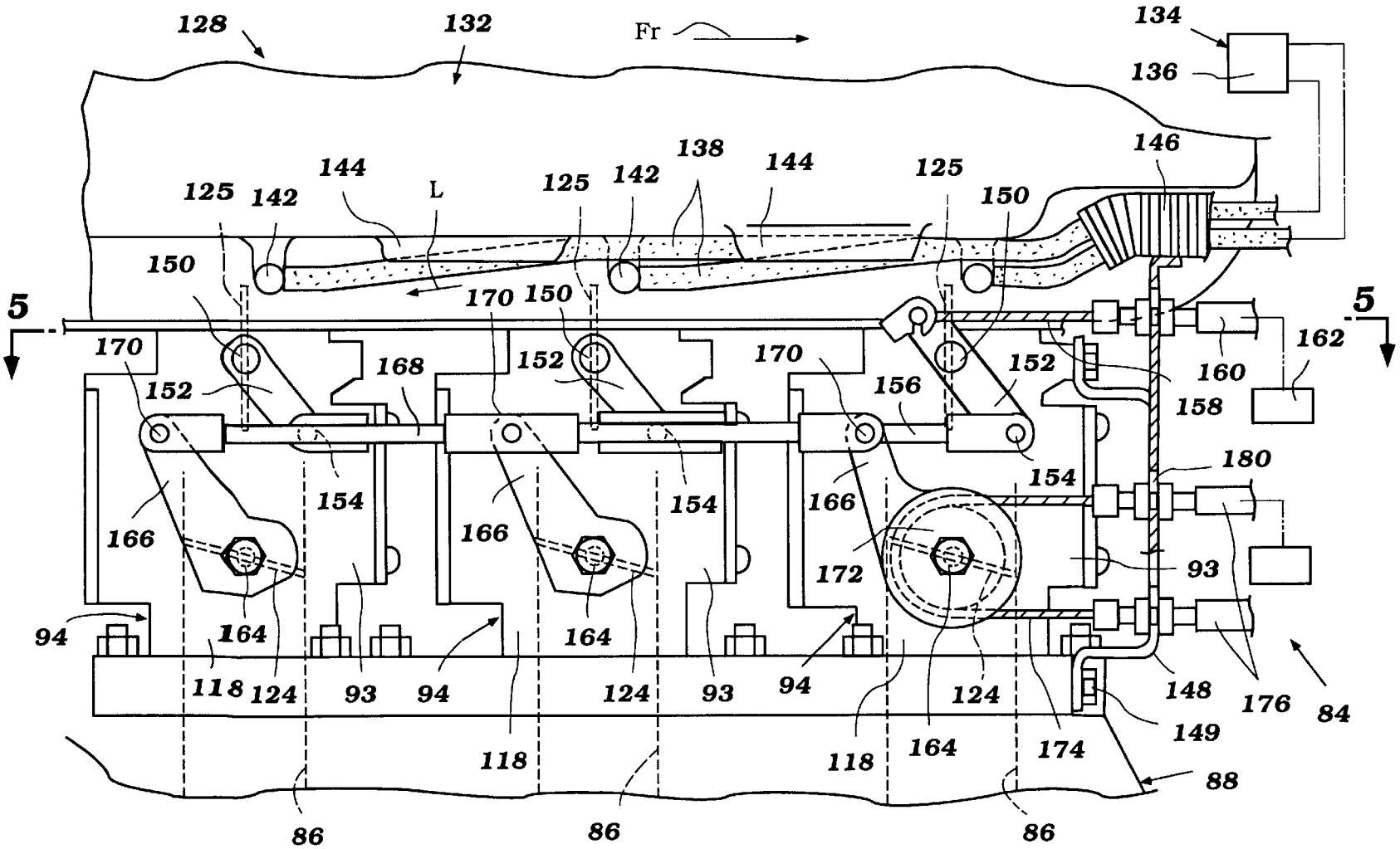
FIG. 4 is a side view of an air intake of the engine illustrated in FIG. 3 and illustrating a intake control mechanism therefor.

Referring to FIGS. 3 and 4, a throttle valve 124 and a choke valve 125 are preferably provided for allowing the watercraft operator to control the rate of fuel and air delivery to the engine 22 for controlling the speed and power output of the engine via a throttle linkage and choke linkage of the carburetor 94. These valves 124,125 and the mechanism for controlling these valves are described in more detail below.

Fuel which is delivered to the carburetor 94 but not delivered to the air flowing therethrough may be returned to the fuel tank 90 through a return line 96. It is contemplated that the fuel may be provided to the engine by indirect or direct fuel injection, as well as via carburation, as known in the art.

The air and fuel mixture (labeled A/F in FIG. 3) selectively passes through an intake port 79 into the crankcase chamber 80 as controlled by a reed valve 98, as is known in the art. As is also well known, an intake port and corresponding reed valve 98 are preferably provided corresponding to each combustion chamber 74. The crankcase chamber 80 is compartmentalized so as to provide a crankcase compression feature for each combustion chamber as is well known in the operation of two-cycle engines.

The fuel and air charge within the crankcase chamber 80 is delivered to its respective combustion chamber 74 through at least one scavenge passage 100 leading to one or more scavenge ports in the cylinder wall.

A suitable ignition system is provided for igniting the air and fuel mixture provided to each combustion chamber. Preferably, this system comprises a spark plug 102 corresponding to each combustion chamber 74. Each spark plug 102 is preferably fired by a suitable ignition system.

Though not illustrated, the engine 22 may include a flywheel connected to one end of the crankshaft 54 and having a number of magnets thereon for use in a pulser-coil arrangement for generating firing signals for the ignition system. In addition, the ignition system may include a battery for use in providing power to an electric starter and other electrical engine features. In addition, a number of teeth may be mounted on the periphery of the flywheel for use in starting the engine 22 with a starter motor (not illustrated).

The engine 22 includes a lubricating system 134 for providing lubricating oil to the various moving parts thereof. Preferably, the lubricating system includes an oil tank or reservoir 136 from which lubricating oil is delivered to and circulated throughout the engine, as is well known to those skilled in the art. In the preferred embodiment, lubricating oil L is delivered from the tank 136, such as with a pump (not shown), into the air stream passing through each carburetor 94. As best illustrated in FIG. 4, an oil delivery line 138 is provided corresponding to each carburetor 94. Each line 138 extends from the lubricant supply (such as the pump) to a connector 141. The connector 141 is connected to an air box 128 of the intake system (described in more detail below), and has a passage therethrough leading from the delivery line 138 to a passage 140 (see FIG. 7) extending through a wall of the air box 128. The lubricant L passes through the passage 140 and then through a tube 143 extending into the air passage 120 through the carburetor 94. The lubricant passes through the tube 143 to a delivery port 142 thereof, and into air passing through the carburetor 94. In this manner, the lubricant lubricates the choke valve 125 and is carried by the air flowing through the carburetor 94 into the engine 20.

As illustrated in FIGS. 4 and 7, the lines 138 are connected to the bottom side of the air box 128. A flange element 144 preferably partially covers the lines 138 to protect them from damage. In addition, a flexible protective sleeve 146 extends about the lines 138 where they pass over a throttle and choke control mounting plate 148 (described in more detail below).

The engine 22 may also preferably include a suitable cooling system (not shown) as known to those skilled in the art.

As stated above, the crankshaft 54 drives the impeller 56 of the propulsion unit 58. Referring to FIG. 1, 3 the end of the crankshaft 54 extends through the crankcase cover to a coupling 102 where it is coupled to an end of the impeller shaft 56.

Still referring to FIG. 1, 3 exhaust gas generated by the engine 22 is routed from the engine to a point external to the watercraft 20 by an exhaust system 103 which includes an exhaust passage 104 (FIG. 3) leading from each combustion chamber 74 through the cylinder block 70. An exhaust manifold 106 is connected to a side of the engine 22. The manifold 106 has three branches with passages leading therethrough (corresponding to the three combustion chambers 74) aligned with the passages 104 leading through the cylinder block 70. Exhaust generated by each combustion chamber 74 is routed through a respective passage 106 to the manifold 106.

The branches of the manifold 106 merge into a single passage 108. This portion of the manifold leads to an expansion pipe 110 positioned generally above the engine 22. The expansion pipe 110 has an enlarged passage or chamber through which exhaust routed from the passage 108 in the exhaust manifold flows.

Exhaust flows from the expansion pipe 110 into an upper exhaust pipe section 112 of the exhaust system. This portion of the exhaust system is tapers to a smaller diameter from that of the expansion pipe 110. This exhaust pipe 112 leads to a water lock 114. The exhaust pipe 112 is preferably connected to the water lock 114 via a flexible fitting, such as a rubber sleeve. The exhaust flows through the water lock 114, which is preferably arranged as known to those skilled in the art, and then passes to a lower exhaust pipe 116 which has its terminus in the chamber 62. In this manner, exhaust flows from the engine 22 through the exhaust system to its discharge within the water flowing through the chamber 62. A catalyst (not shown) may be positioned within the exhaust system 103 for catalyzing the exhaust gases.

Means (not shown) are provided for controlling the flow of exhaust gases through the exhaust passages 104 from the combustion chambers 74. This means may comprise a sliding knife, rotating or other type valve, and means for moving the valve, as well known to those skilled in the art.

FIGS. 3–9 illustrate in more detail the air intake system 84 of the present invention. As illustrated, the intake manifold 88 extends outwardly from the engine 22 and then curves upwardly to each carburetor 94. An intake passage 86 is provided through the manifold 88 corresponding to each cylinder or combustion chamber 74. A carburetor 94 is provided corresponding to each combustion chamber 74 as well. Thus, in the present embodiment there are three passages 86 and three carburetors 94. Each carburetor 94 preferably comprises a body 118 having a passage 120 therethrough leading, at a bottom end, to the passage 86 in the manifold 88.

The throttle valve 124, which is preferably of the butterfly type, is positioned within the passage 120 through the body 118 of the carburetor 94. In addition, the choke valve 125, which is also preferably of the butterfly type, is positioned within the passage 120 through the body 118 of the carburetor 94 upstream of the throttle valve 124.

A mounting plate 126 is connected to the body 118 of each carburetor 94 opposite its end connected to the intake manifold 88. The mounting plate 126 preferably has a passage therethrough in alignment with the passage 120 through the body 118 of each carburetor 94. The mounting plate 126 is preferably connected to the head 72 of the engine 22.

An intake box or cover 128 is positioned above the mounting plate 126. The box 128 preferably comprises a top member or cover connected to a bottom member or base cooperating to define an interior chamber. The box 128 is preferably connected to the mounting plate 126 and the carburetor body 118.

An air horn or intake pipe 131 extends upwardly into the chamber defined by the box 128, corresponding to each carburetor 94. The intake pipe 131 defines an air passage leading to the passage 120 through the carburetor 94. The air box 128 is preferably of a large size, with a top end of the intake pipe 131 positioned well above a bottom surface of the box. In this manner, water which enters the air box 128 fills the bottom of the air box but does not run into the intake pipe 131 and the engine. One or more drain ports (not shown) may be provided in the bottom of the air box 128 permitting water to drain therefrom.

An intake control mechanism 132 for controlling the flow of air through the intake system 84 will now be described in conduction with FIGS. 3–9. As illustrated, throttle control means are provided for moving each throttle valve 124 and choke control means are provided for moving each choke valve 125.

Figure 5:
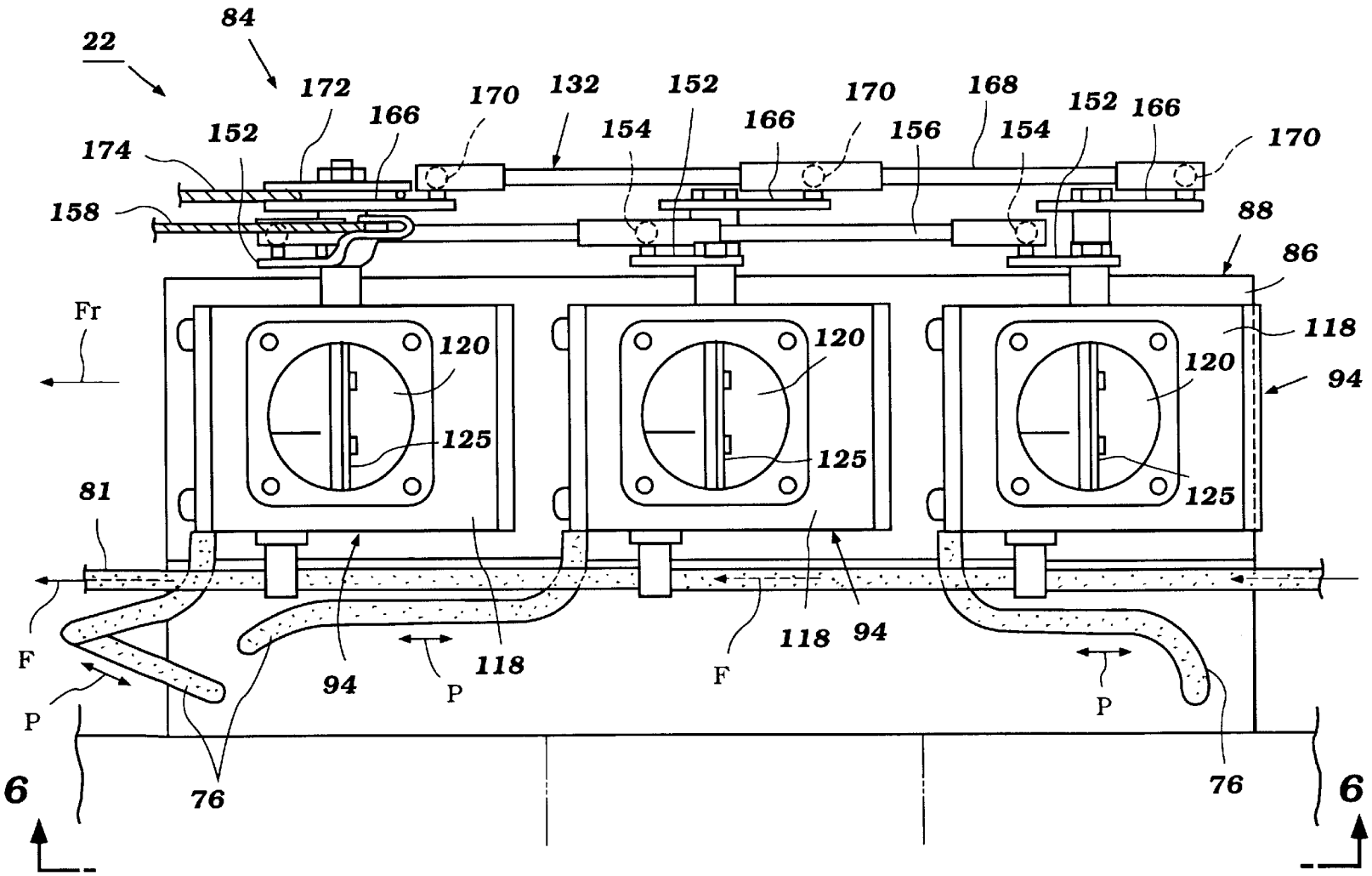
FIG. 5 is a top view the air intake illustrated in FIG. 4 taken along line 5—5 therein.
Figure 8:
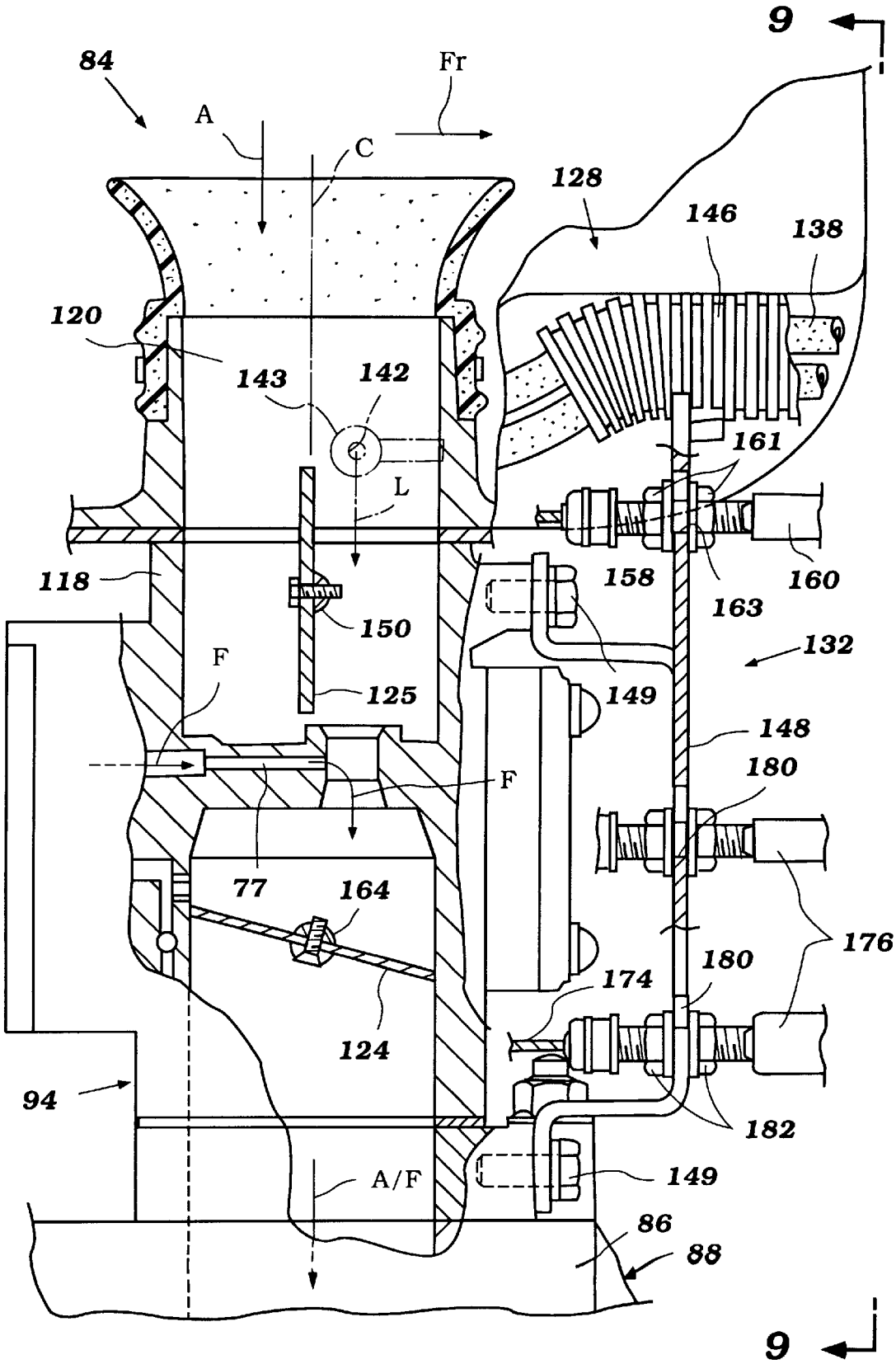
FIG. 8 is a partial cross-sectional side view of the portion of the air intake and control mechanism illustrated in FIG. 7 taken in the direction of line 8—8 therein.
Figure 9:
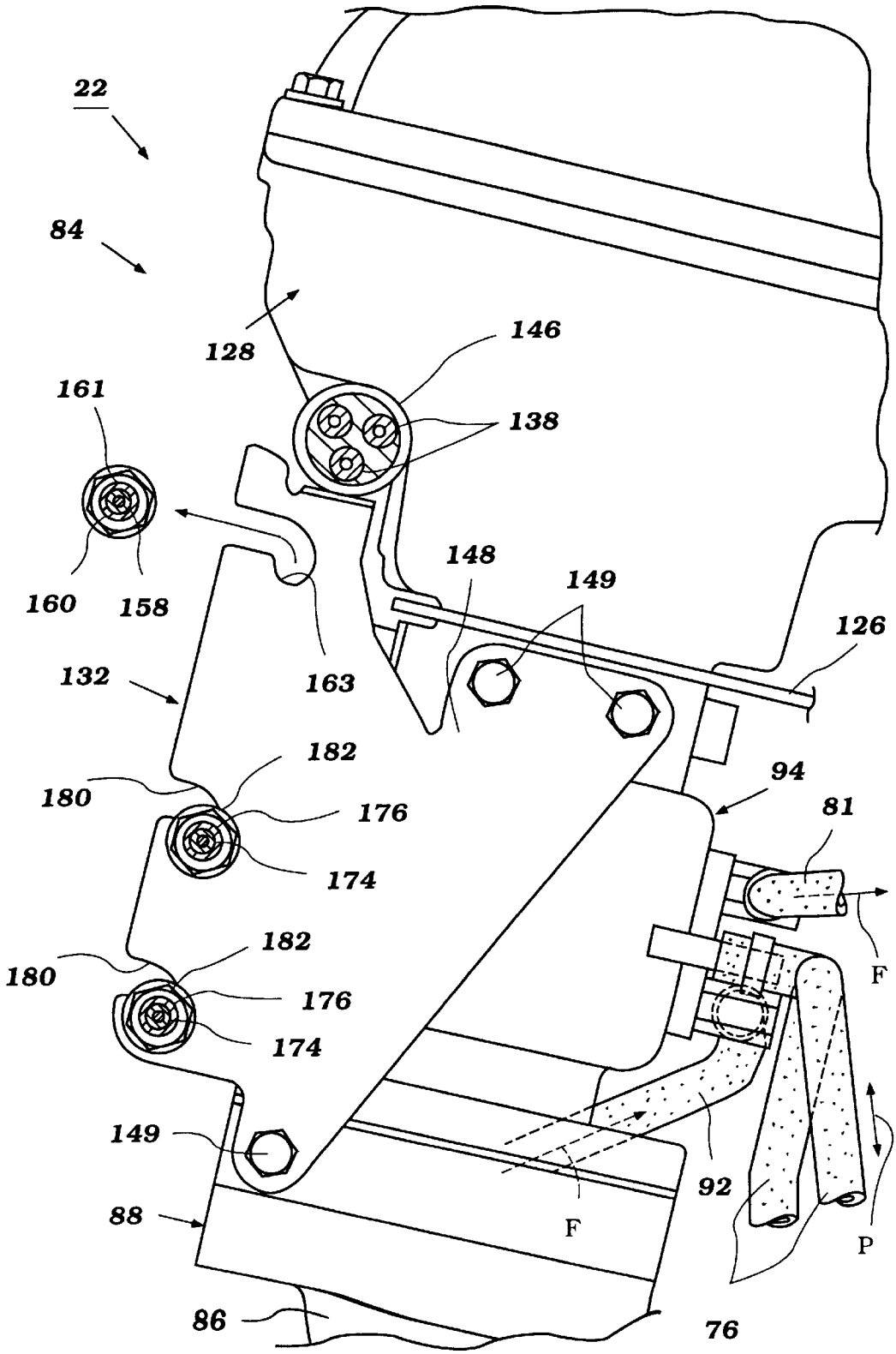
FIG. 9 is a partial end view of the air intake and intake control mechanism in accordance with the present invention in the direction of lines 9—9 in FIG. 8.

Referring to FIGS. 4 and 5, the means for moving each choke valve 125 comprises a choke control including a linkage connected to each valve 125 and means for moving the linkage. The linkage includes a shaft 150 to which the choke plate or valve 125 is connected, the shaft 150 rotatably mounted with respect to the carburetor body 118. As best illustrated in FIG. 8, each shaft 150 is preferably positioned along a centerline C extending through the passage 120 through the carburetor 94.

One end of the shaft 150 extends through the body 118 to a lever element 152. Each lever 152 has one portion connected to the shaft 150, and an end 154 connected to a link 156.

As illustrated, the end 154 of the lever 152 may include a ball-shaped element positioned within a slotted portion of the link 156 so as to permit some relative movement (rotation) of the two elements with respect to one another.

One of the levers 152 is connected near its midpoint to its respective shaft 150, and has a wire 158 or similar actuator connected to an end opposite an end connected to a link 156 leading to the next lever. The means for moving the linkage in this embodiment comprises the wire 158 and means for moving the wire.

As illustrated, the wire 158 extends through a guide element 160 connected to the mounting plate 148. The guide element 160 defines a passage through which the wire 158 extends. In order to prevent simultaneous movement of the guide element 160 with the wire 158, the guide element 160 is secured to the plate 148. Preferably, the guide element 160 is connected to the mounting plate 148 with a pair of nuts 161. In particular, the plate 148 includes a cut-out or slotted area 163 (see FIG. 7) in which the guide element 160 is positioned. A portion of the outer surface of the guide element 160 is threaded for engagement with the nuts 161. The nuts 161 are positioned on opposite sides of the plate 148 and tightened towards one another, removably fixing the guide 160 to the plate 148.

The plate 148 is mounted at one end of the engine 20 near one of the carburetors 94, and extends in a plane generally perpendicular to the a line extending from the front (Fr) to the rear of the watercraft 24. The plate 148 is connected to and supported by the engine 20. Preferably, one or more threaded fasteners 149 connect the plate 148 to the end carburetor 93.

The means for moving the wire 158 preferably includes a control member operable by the operator of the watercraft 20, such as a pull-type choke control as is known to those skilled in the art. Of course, the choke may be motor controlled or the like as well.

A spring 159 is provided around the portion of each shaft 150 extending out of the carburetor 94 for biasing the choke valve 125 into an open position. Preferably, the spring 159 is a coil spring wrapped around the shaft 150, and engaging the shaft 150 and the body 118 of the carburetor.

Operation of the choke valve 125 is as follows. In the event an operator of the watercraft 20 wishes to operate the choke feature, the operator pulls the choke control. This has the effect of drawing the wire 158 in the direction to the right as illustrated in FIG. 4, overcoming the spring force. As the wire 158 moves to the right, the links 156 all move to the left (through rotation of the lever 152, since the wire 158 and connector 158 are connected to opposite ends of this lever). As the links 156 move to the left, each choke valve 125 rotates clockwise, closing the passage 120 through its respective carburetor 94 and restricting the flow of air therethrough.

When the operator wishes to shut of the choke, the control is moved inwardly and the springs 159 bias the choke plates or valves 125 back to their fully open position as illustrated in FIG. 8.

The means for moving each throttle valve 124 preferably comprises a throttle control including a linkage mechanism and means for moving the linkage. As illustrated, each throttle valve 124 plate is mounted to a shaft 164 which is, in turn mounted for rotation with respect to the body 118 of the carburetor 94. An end of the shaft 164 extends out of the body to a lever element 166. The levers 166 are connected to one another by links 168 through swivel ball connections 170, similar to those described above.

A drive wheel 172 is connected to at least one of the shafts 164. A drive cable 174 extends around the drive wheel 172. First and second portions of the cable 174 extends through a wire guide 176 passing through the mounting plate 148.

Means are provided for moving the cable 174. Preferably, the means comprises a throttle control 178 positioned on the steering handle 40 of the watercraft 20.

In a mounting similar to that described above, each wire guide 176 is positioned within a slot 180 in the plate 148. Each guide 176 is connected to the plate 148 via a pair of nuts 182 positioned on a threaded outer portion of the guide 176 and tightened therealong on opposite sides of the plate 148.

As with the choke valves 125, means are provided for biasing each throttle valve 124. Preferably, the means comprises a spring 184 provided on each shaft 164 for biasing the valve 124 into a closed position.

Operation of the throttle control is as follows. When not being operated by the operator, the intake control is arranged so that each valve plate 124 is closed, as illustrated in FIG. 4. The operator moves the throttle control 178, moving the cable 174. As the cable 174, it effectuates rotation of the drive wheel 172, and thus the lever 166 connected thereto and the other levers through the links 168. As the cable moves 174, each valve 124 is rotated into an open position, as illustrated in FIG. 8. This has the effect of opening the passage 120 through each carburetor 94, allowing more air to flow therethrough and increasing engine speed.

Advantageously, the intake control of the present invention is effective in controlling the flow of air provided to the engine 20 for combustion. Further, and most importantly, the intake control of the present invention allows for use of a large intake box 128. First, and as illustrated in FIGS. 4 and 5, the choke control linkage is positioned between the throttle control linkage and the intake member, along that portion of the air intake between the choke and throttle valves 125,124. By this positioning of the choke linkage, the choke linkage does not interfere with the use of the large intake box 128. In addition, due to the overlapping arrangement of the choke and throttle linkages, the throttle linkage is not displaced by the positioning of the choke linkage into a position which might interfere with another part of the engine or its controls.

In order to accommodate the overlapping of these linkages, the connection points of the levers 152 to the links 156 of the choke control are alternately spaced from the connection points of the levers 166 to the links 168 of the throttle control.

In addition, the arrangement of the throttle and choke control permits use of long levers 152,166, such that the throttle and choke valves 124,125 are easy to move against the spring force applied to them.

Of course, the foregoing description is that of preferred embodiments of the invention, and various changes and modifications may be made without departing from the spirit and scope of the invention, as defined by the appended claims.

What is claimed is:

1. An intake control mechanism for an internal combustion engine having a plurality of combustion chambers, an air intake system defining, at least in part, a plurality of parallel intake passages each leading to a respective one of said combustion chambers, a plurality of throttle valves each movably positioned in a respective one of said intake passages about parallel throttle valve axes, said throttle valves each being movable about their respective throttle valve axes between an open and a closed position, a plurality of choke valves each positioned in a respective one of said intake passages about parallel choke valve axes that are parallel to said throttle valve axes, said choke valves each being movable about their respective choke valve axes between an open and closed position, said throttle valves positioned in a downstream direction towards said engine in said intake passages from the respective of said choke valves, a choke control for moving said choke valves in unison between their open and closed positions and a throttle control for moving said throttle valves in unison between their open and closed positions, said choke control including a choke actuating link and said throttle control including a throttle actuating link, said choke and throttle actuating links being positioned at the same side of said intake passages in side by side relation to each other at different distances from said intake passages.

2. The intake control mechanism in accordance with claim 1, wherein said intake passages each has a top end positioned within an intake box of the air intake system.

3. The intake control mechanism in accordance with claim 2, wherein said choke actuating linkage is connected to the respective choke valve by a respective lever affixed to a respective choke valve that defines the choke valve axes.

4. The intake control mechanism in accordance with claim 3, wherein said throttle actuating linkage is connected to the respective throttle valve by a respective lever affixed to a respective throttle valve that defines the throttle valve axes.

5. The intake control mechanism in accordance with claim 4, wherein the points of connection between said choke levers and the choke actuating link and the points of connection between said throttle levers and the throttle actuating link alternate.

6. The intake control mechanism in accordance with claim 1, wherein said choke actuating link is positioned between said air intake passages and said throttle actuating link.

7. The intake control mechanism in accordance with claim 1, further including first means for biasing said throttle valves into a closed position and second means for biasing said choke valves into an open position.

8. The intake control mechanism in accordance with claim 7, wherein said first and second means comprise springs.

9. The intake control mechanism in accordance with claim 1, wherein said choke control includes means for moving said choke actuating link from a remote location and wherein said throttle control includes means for moving said throttle actuating link from a remote location.

10. The intake control mechanism in accordance with claim 9, wherein said means comprises cables.

* * * * *